US007743542B1

(12) United States Patent
Novak

(10) Patent No.: US 7,743,542 B1
(45) Date of Patent: Jun. 29, 2010

(54) MAGAZINE ENTRANCE GUIDE

(75) Inventor: Robert Novak, East Hampton, NY (US)

(73) Assignee: Sportco, Inc., East Hampton, NY (US)

( * ) Notice: Subject to any disclaimer, the term of this patent is extended or adjusted under 35 U.S.C. 154(b) by 311 days.

(21) Appl. No.: 12/151,751

(22) Filed: May 7, 2008

Related U.S. Application Data

(60) Provisional application No. 60/947,541, filed on Jul. 2, 2007.

(51) Int. Cl.
*F41A 9/61* (2006.01)

(52) U.S. Cl. ..... 42/7; 42/49.02; 42/90

(58) Field of Classification Search ..... 42/7, 42/49.02, 72, 90, 106
See application file for complete search history.

(56) References Cited

U.S. PATENT DOCUMENTS 984,519 A 2/1911 Browning
3,999,321 A * 12/1976 Musgrave ..... 42/71.02
4,520,585 A * 6/1985 Barrett ..... 42/7
4,570,370 A 2/1986 Smith et al.
5,052,140 A * 10/1991 Smith ..... 42/7
5,621,995 A * 4/1997 Smith ..... 42/7

OTHER PUBLICATIONS

"Mag Guides," http://www.smithandalexander.com/guides.html, Smith & Alexander, Inc., 1999.

* cited by examiner

*Primary Examiner*—J. Woodrow Eldred
(74) *Attorney, Agent, or Firm*—Abelman, Frayne & Schwab

(57) ABSTRACT

An assembly for facilitating the insertion of a fresh magazine into a magazine receiver opening of a pistol having a handle frame member to which a pair of opposing hand grips are removably attachable. The magazine insertion guide is secured in position on the butt portion of the frame member by engagement of a plurality projecting securing members that are concealed by, and cooperatively engage interior elements of specially configured hand grips when the grips are attached to the frame member, the exterior surfaces of which mimic the original equipment grips.

13 Claims, 5 Drawing Sheets

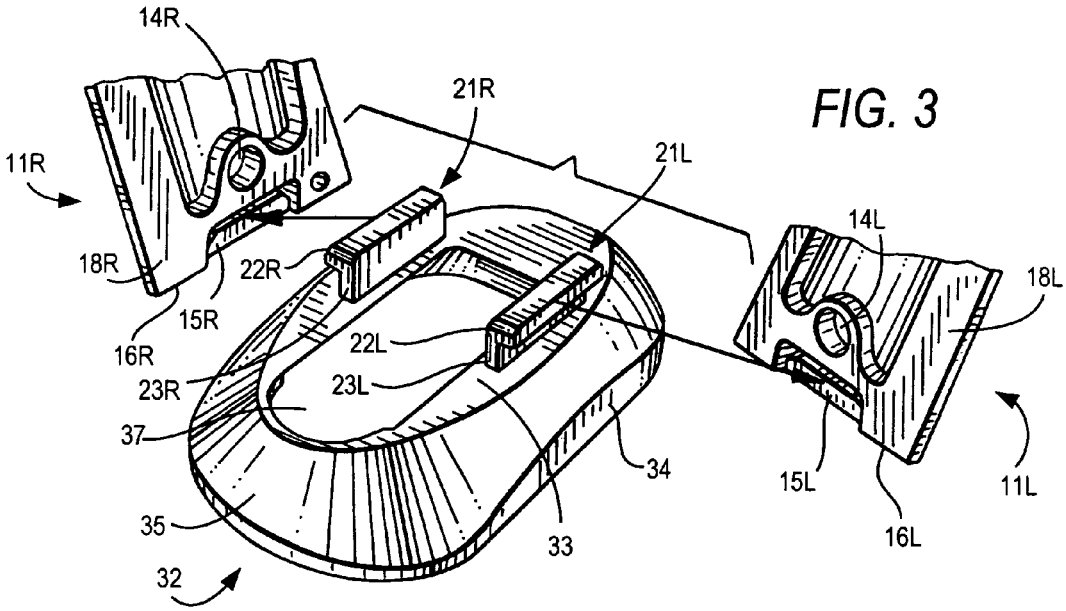
FIG. 3
FIG. 4
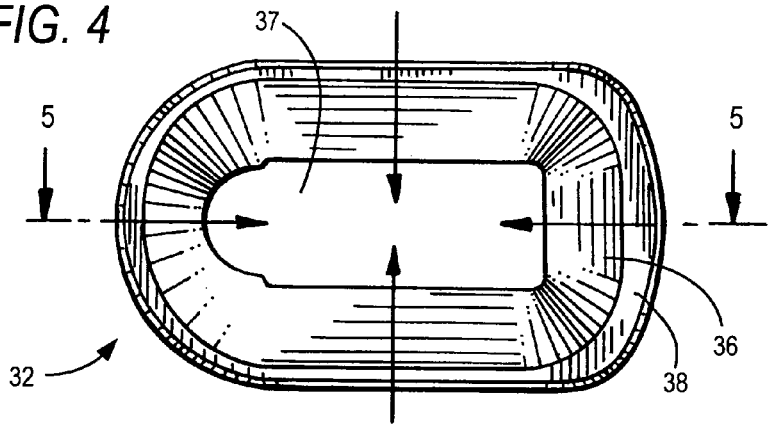
FIG. 5
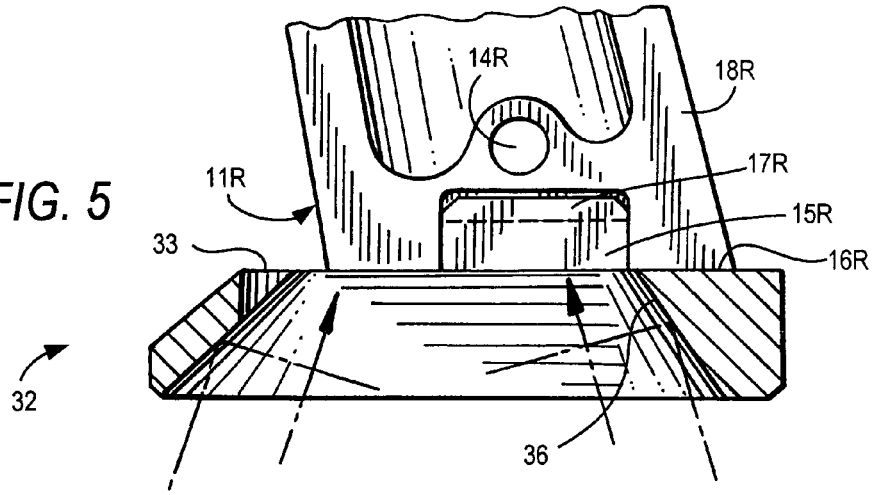

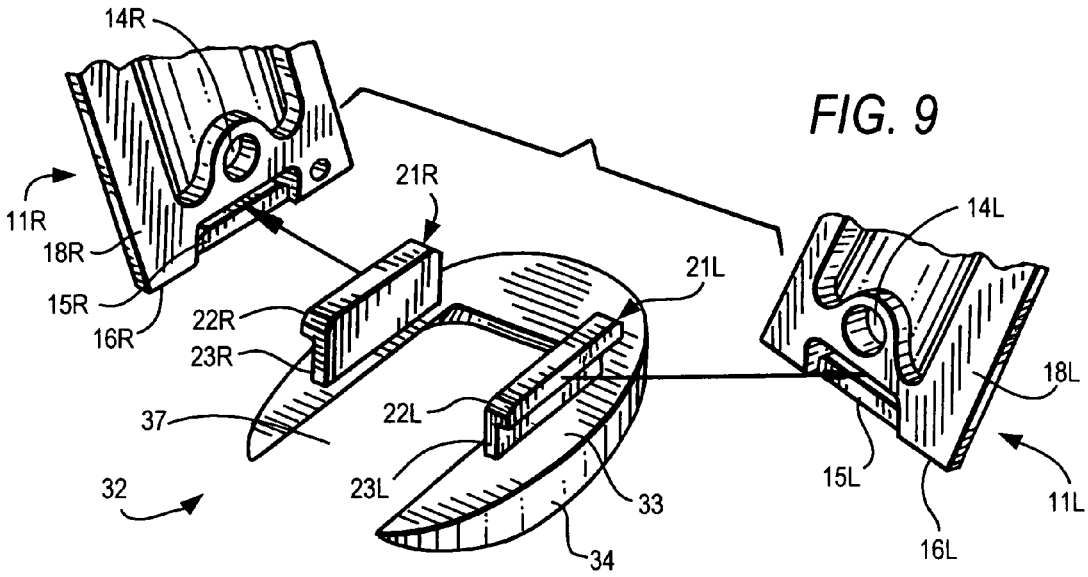
FIG. 9
FIG. 10
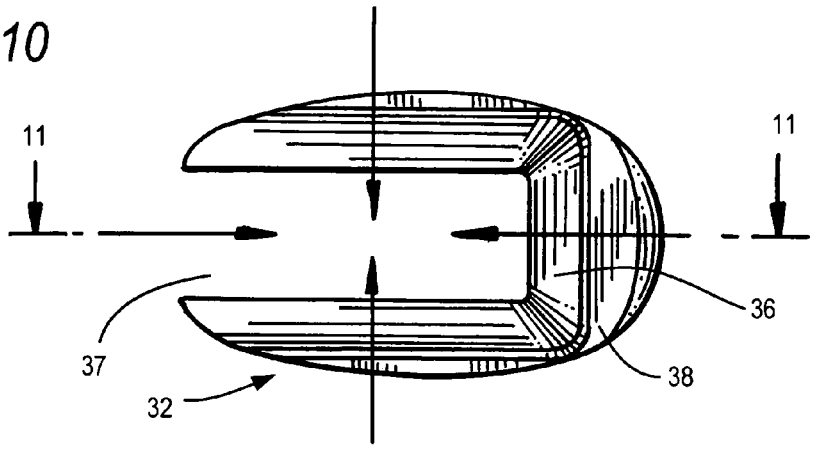
FIG. 11
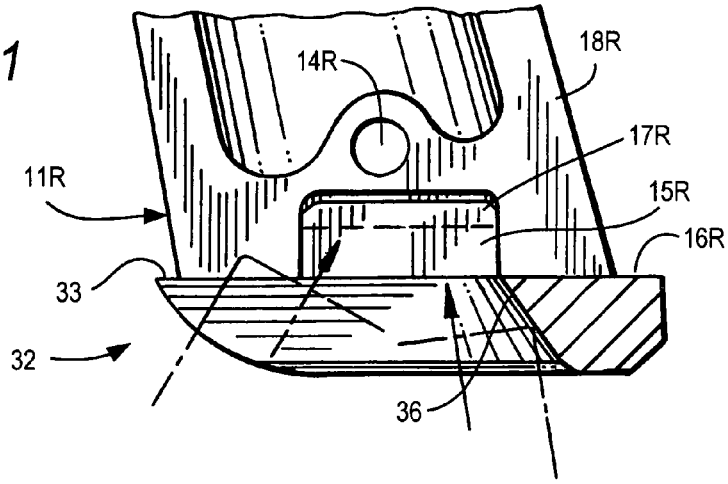

MAGAZINE ENTRANCE GUIDE

CROSS-REFERENCE TO RELATED APPLICATION

This patent application claims the benefit of U.S. Provisional Application Ser. No. 60/947,541, filed Jul. 2, 2007, the disclosure of which is incorporated by reference herein in its entirety.

BACKGROUND

1. Field of the Invention

The present invention relates to an assembly for facilitating the insertion of a fresh magazine into a magazine receiver opening of a pistol.

2. Background of the Invention

A semi-automatic pistol is a type of firearm that uses a magazine for the storage and subsequent delivery of rounds of ammunition, or cartridges, to the chamber. A magazine holds a finite number of rounds. When the magazine is empty, it can be ejected from the firearm and replaced by another full magazine. Compared to a revolver or other type of firearm, a firearm that uses a magazine significantly speeds the process of reloading the firearm, allowing the user rapid access to a relatively large amount of ammunition in a relatively short span of time. An example of a pistol that uses a magazine is described in U.S. Pat. No. 984,519 to Browning, the disclosure of which is incorporated by reference herein in its entirety. Semi-automatic pistols produced in accordance with the Browning patent have been manufactured in large volume for use by the military, use .45 caliber ammunition and are popularly known by the trademark and referred to as the "COLT®45".

The replacement of a magazine requires the user to align the fresh magazine with the pistol magazine receiver opening. If the user is in a stressful environment, however, and especially if time is of the essence, then the proper alignment of the magazine with the pistol magazine receiver opening can become more difficult and time-consuming. Oftentimes, the user will waste precious seconds while attempting to properly align a fresh magazine with the magazine receiver opening and may fumble when trying to align and insert it. Examples of stressful environments for the user include organized competitive events, such as those held by the International Defensive Pistol Association (IDPA) or the United States Practical Shooting Association (USPSA), which are generally timed events. Other stressful environments include law enforcement or military use and/or field training exercises.

One solution to this problem has involved the use of a magazine insertion guide having a wide-angled opening.

Competitive shooters have been known to incur injuries to the portion of their hand that is gripping the pistol in the vicinity of the butt when the other hand fails to get the upper end of the fresh magazine in proper alignment.

For example, U.S. Pat. No. 4,570,370 to Smith et al. discloses a wide-angled bifurcated opening magazine entrance guide extension of a pistol mainspring housing. The extension of the grip and provision of the wide-angled magazine receiver entrance guide is provided in a unitary structure with the pistol mainspring housing. The extended structure is attached to the pistol in the same manner as a stock mainspring housing without any machining alteration of the basic stock pistol.

The device of U.S. Pat. No. 4,570,370 has been commercially produced and cannot be easily installed, removed, and/or replaced by the average gun enthusiast. For example, the device requires the removal and insertion of a main spring housing pin and a main spring cap pin, respectively, each time the user wishes to interchange the device. The tasks are difficult because the user must (1) first align the main spring housing pin with the openings in the grip and the opening through the mainspring housing; and (2) then align the spring cap pin with a housing opening whilst not disturbing the leafspring, which is held in place by the mainspring housing, whose proper situation is delicate, and without which the firearm will not operate. The device has proved difficult to install and remove by the average user and the services of a gunsmith are used.

Furthermore, certain law enforcement agents are required to carry their firearms at all times. However, when these agents arrive at a competitive shooting event, they may wish to switch from a model more suitable for, the constant wear to a model more suitable for competition.

By reason of the inconveniences above, it is an object of the present invention to provide an assembly for facilitating the insertion of a fresh magazine into a pistol magazine receiver opening that can be easily secured to the pistol by the average user and without the aid and skills of a gunsmith.

It is another object of the present invention to provide an assembly for facilitating the insertion of a fresh magazine into a pistol magazine receiver opening, which allows fast and easy interchangeability of several different sized magazine insertion guides with other common elements of the firearm.

SUMMARY OF THE INVENTION

The above object and other advantages are achieved by the present invention which includes a magazine insertion guide that mates in interlocking relation with a pair of opposing hand grips. The magazine insertion guide has a flat upper surface for engaging the butt portion of the handle frame member, and a plurality of guide securing members extend upwardly from the upper surface of the magazine insertion guide which are spaced for close-fitting relation to the handle frame member. The pair of opposing hand grips are removably attachable to the sides of the handle frame member, wherein the interior surfaces of the grips are contoured to receive the securing members in close-fitting inter-locking relation. The magazine insertion guide is secured in position on the butt portion of the frame member when the grips are attached to the frame member. The disadvantages heretofore associated with the prior art are overcome by the present invention of an assembly for facilitating the insertion of a fresh magazine into a magazine receiver opening of a pistol having a handle frame member, wherein the handle frame member has a flat butt portion.

BRIEF DESCRIPTION OF THE DRAWINGS

Further advantages and features of the present invention will become apparent from the detailed description of the invention that follows when read in conjunction with the accompanying drawings, in which:

FIG. 3 is an exploded perspective view of the assembly of FIG. 1;

FIG. 4 is a bottom view of the magazine insertion guide of FIG. 1;

FIG. 5 is a cross-sectional view of the assembly of FIG. 1 taken along line 5-5;

FIG. 9 is an exploded perspective view of an alternative embodiment of the assembly including hand grips and a magazine insertion guide;

FIG. 10 is a bottom view of the magazine insertion guide of FIG. 9;

FIG. 11 is a cross-sectional view of the assembly of FIG. 9 taken along line 11-11.

To facilitate understanding of the invention, identical reference numerals have been used, when appropriate, to designate the same or similar elements that are common to the figures. Further, unless stated otherwise, the figures are not drawn to scale, but are shown for illustrative purposes only.

The novel features of the present invention, which are considered as characteristic for the invention, are set forth in the appended claims. The invention itself, however, both as to its construction and its mode of operation, together with additional advantages and objects, will be best understood from the following detailed description of the preferred embodiments, when read with reference to the accompanying drawings.

DETAILED DESCRIPTION OF THE PREFERRED EMBODIMENTS

FIGS. 1-5 illustrate the assembly of the present invention according to a first preferred embodiment.

Figure 1:
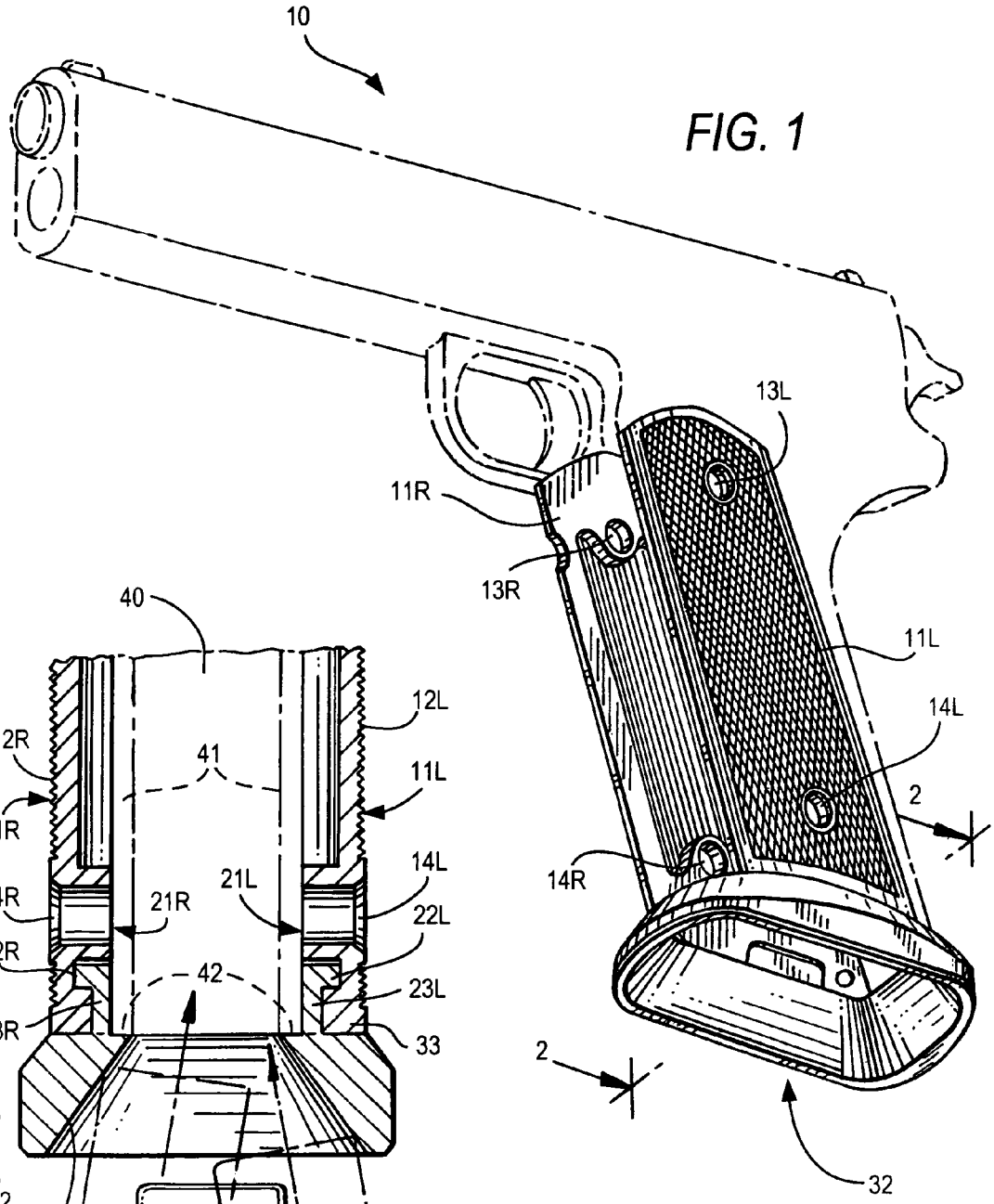
FIG. 1 is a perspective view of the assembly of the present invention including hand grips and a magazine insertion guide.

Referring to FIG. 1, the assembly 10 includes a pair of opposing hand grips 11L, 11R and the magazine insertion guide 32 of the present invention. The pair of opposing hand grips 11L, 11R are removably attached to the sides of the handle frame member 41 as further described in FIG. 2. Each hand grip is provided with an upper opening 13L, 13R and a lower opening 14L, 14R which receive screws (not shown) in order to secure the hand grips 11L, 11R to the handle frame member. Preferably, the hand grips 11L, 11R are configured to replace the original equipment grips of a commercially produced pistol, incorporating Browning's construction of semi-automatic pistol having a magazine receiver in the handle portion. For example, the hand grips 11L, 11R may replace the grips of an original or a replica of a COLT® semi-automatic model 1911. As discussed in further detail below, the magazine insertion guide 32 is engaged by, and secured in position on the butt portion of the frame member when the grips 11L, 11R are attached to the frame member.

Figure 2:
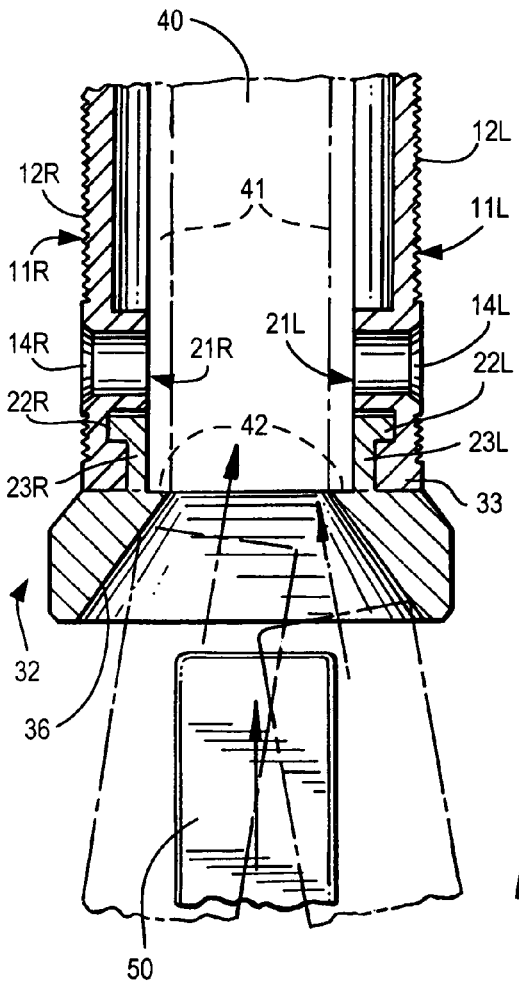
FIG. 2 is a front cross-sectional view of the assembly of FIG. 1 taken along line 2-2.

Referring to FIG. 2, the magazine insertion guide 32 includes an inner surface 36 having a wide-angled configuration in order to direct a fresh magazine into the cavity 40 of the pistol, as shown by the arrows. The inner surface 36 effectively creates a "funnel." Therefore a user can more rapidly insert a fresh magazine 50 without having to precisely align the magazine 50 with the pistol magazine receiver opening as defined by the cavity 40. The hand grips 11L, 11R each include a friction surface portion 12L, 12L. The upper openings 13L, 13R (not shown) and the lower openings 14L, 14R extend through the entire cross section of the hand grips and may terminate in a beveled opening at the outer surface. The handle frame member 41 terminates at a flat butt portion 42. As shown in further detail by FIG. 3, the magazine insertion guide 32 has a flat upper surface 33 and a plurality of guide securing members 21L, 21R extending upwardly from the upper surface 33. In a preferred embodiment, the guide securing members 21L, 21R are integral with the magazine insertion guide 32. The guide securing members 21L, 21R include a leg portion 23L, 23R which terminates in an outwardly disposed flange 22L, 22R. In a particularly preferred embodiment, one pair of securing members is provided. Alternatively, additional securing members can be provided. The guide securing members 21L, 21R can conveniently be configured of rectilinear elements or other shapes can be employed. The plurality of guide securing members 21L, 21R are positioned for close-fitting relation to the handle frame member 41.

As shown in further detail in FIG. 3, the magazine insertion guide 32 has a flat upper surface 33, an outer surface 35, and a side wall 34. The outer surface 35 tapers outwardly towards a bottom surface (see FIG. 4). The guide securing members 21L, 21R include a leg portion 23L, 23R which terminates in an outwardly disposed flange 22L, 22R. In a preferred embodiment, the portion of the securing member 21L, 21R that extends from the upper surface 33 of the magazine insertion guide 32 is about 0.15 inches/3.75 mm wide, about 0.77 inches/19.25 mm long and about 0.11 inches/2.75 mm thick and the lower surface of the flange 22L, 22R extends about 0.3 inches/7.5 mm from the junction with the leg portion, and is about 0.08 inches/2.0 mm thick. As will be apparent to one of ordinary skill in the art, in other embodiments these dimensions can be varied.

The magazine insertion guide 32 defines an opening 37 that aligns with the bottom of the cavity (see FIG. 2). The hand grips 11L, 11R have interior recesses 18L, 18R, that are contoured to receive the securing members 21L, 21R in close-fitting interlocking relation. During assembly, the magazine insertion guide 32 is inserted against the flat butt portion 42 of the handle frame member 41 so that the flat upper surface 33 contacts the flat butt portion 42, and also so that the lower edge 16L, 16R of the grips rests against the flat upper surface 33. The hand grips 11L, 11R are then securely attached to the handle frame member 41 with screws so that the guide securing members 21L, 21R inter-lock with corresponding female slots 15L, 15R disposed in the hand grips 11L, 11R.

Once assembled, the magazine insertion guide 32 is secured in position in close-fitting relation to the flat butt portion 42 of the frame member 41 with its opening 37 immovably aligned with the opening of the magazine receiver 40 in frame member 41, as best shown in FIG. 4. The inner surface 36 is tapered towards the opening 37 from bottom surface 38 in order to direct a fresh magazine 50 into the cavity 40 of the pistol, as generally indicated by the arrows.

As shown in FIG. 5, the interior surface 18R of the hand grip 11R defines a lower opening 14R for receiving a screw (shown) and is contoured to receive the guide securing member 21R in close-fitting interlocking relation. The female slot 15R is disposed along the lower edge 16R of the hand grip 11R. The female slot 15R further includes a recess portion 17R for receiving the corresponding outwardly disposed flange 22R of the guide securing member 21R. This close-fitting interlocking relation secures the magazine insertion guide 32 to the butt portion 42 of the handle frame member 41.

A variety of magazine insertion guides having different sizes and/or shapes may be utilized with a single pair of hand grips, as described below with reference to FIGS. 6-11.

Figure 6:
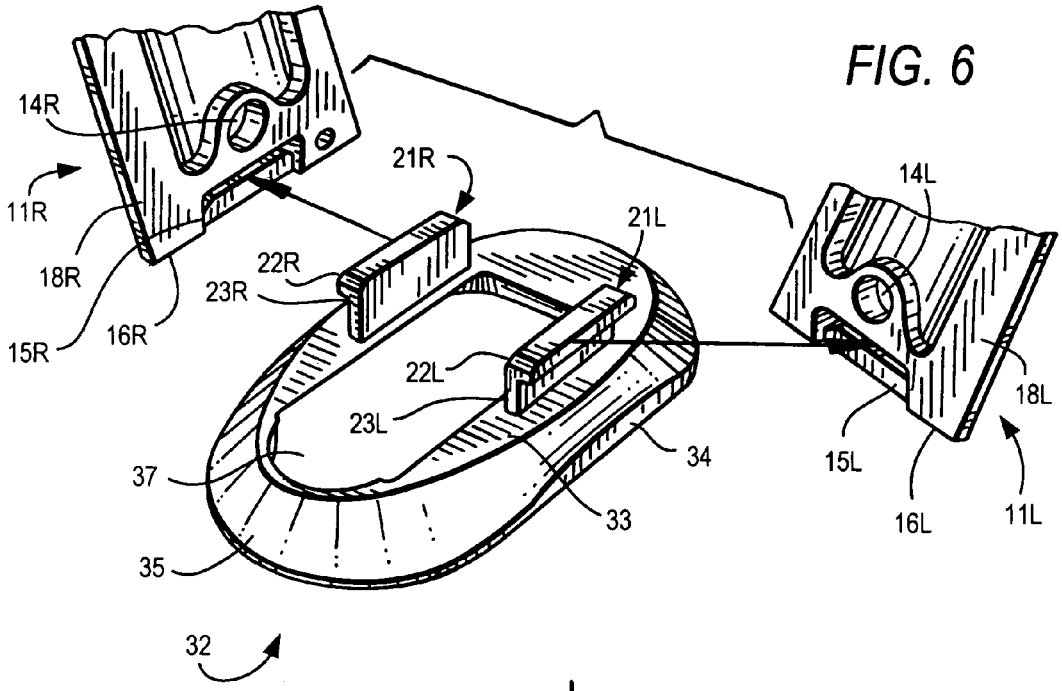
FIG. 6 is an exploded perspective view of an alternative embodiment of the assembly including hand grips and a magazine insertion guide.
Figure 7:
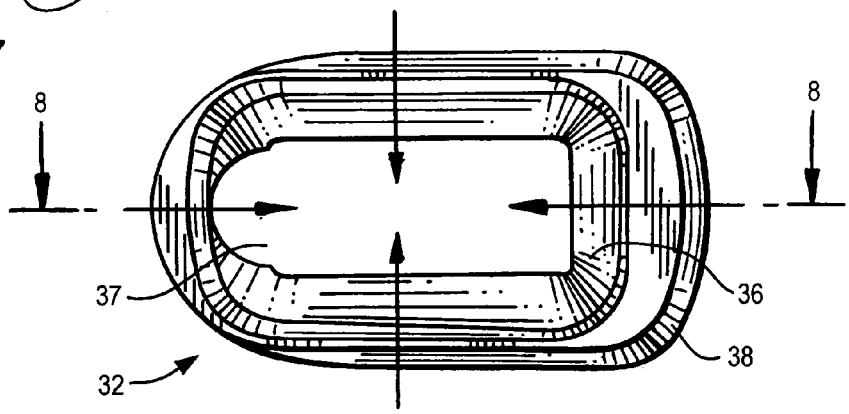
FIG. 7 is a bottom view of the magazine insertion guide of FIG. 6.
Figure 8:
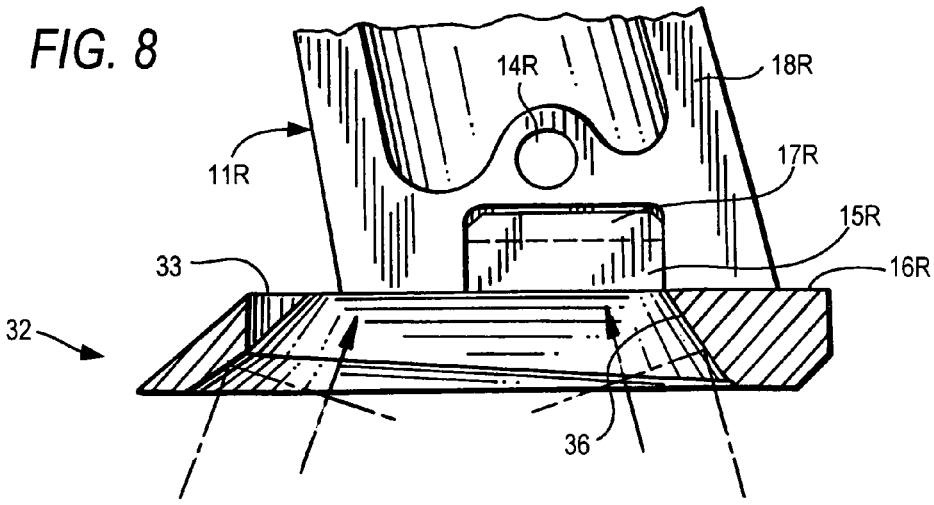
FIG. 8 is a cross-sectional view of the assembly of FIG. 6 taken along line 8-8.

FIGS. 6-8 illustrate a second preferred embodiment which differs from the first embodiment primarily in the size and shape of the magazine insertion guide 32. The magazine insertion guide 32 of this second preferred embodiment is intended for a standard magazine base pad, in contrast to the first embodiment shown in FIGS. 1-5 which depicts a longer magazine insertion guide 32 that flares further downwards and outwards and requires an extended magazine base pad or a longer, higher-capacity magazine.

FIGS. 9-11 illustrate a third preferred embodiment which differs from the first and second embodiments primarily in the size and shape of the magazine insertion guide 32. The magazine insertion guide 32 of the third preferred embodiment is u-shaped with an open side pointing towards the barrel of the gun. The sidewall 34 of the magazine insertion guide 32 generally tapers towards the flat upper surface 33 near the open side of the u-shaped opening 37. This allows the magazine insertion guide 32 to closely follow the contours of the pistol.

Figure 12:
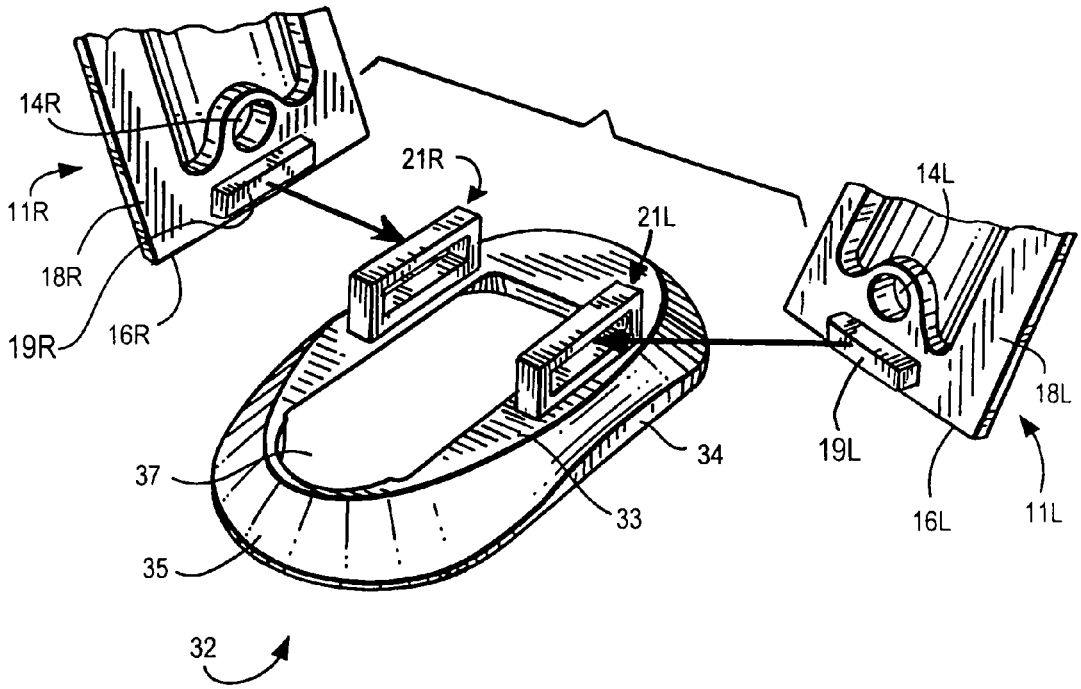
FIG. 12 is an exploded perspective view of an alternative embodiment of the assembly including hand grips and a magazine insertion guide.

As shown in FIG. 12, the orientation of the male and female interlocking parts of the assembly can be reversed. For example, the guide securing members 21L, 21R can terminate in an opening 24L, (24R not shown) and the grips provided with an interior projecting members 19L, 19R, that respectively are received in the openings 24L, 24R of the adjacent securing members.

The magazine insertion guide 32 can be formed from metal, plastic, resinous fibre, and the like. The magazine insertion guide 32 can further be formed from a single piece of material. The hand grips 11L, 11R can be formed from metal, plastic, resinous fibre, and the like.

In other embodiments of the present invention, only one of the hand grips is associated with a securing member. In these embodiments the other hand grip can be secured to the magazine insertion guide by a screw connection passing through an opening in a member that is projecting from the flat upper surface of the magazine insertion guide.

Although various embodiments describing the invention have been set forth above to enable those of ordinary skill in the art to make and use the invention, the description should not be construed to limit the invention, and various modifications and further variations can be made by those with ordinary skill in the art, and the scope of the invention is to be determined by the claims that follow.

I claim:

1. An assembly for facilitating the insertion of a fresh magazine into a magazine receiver opening of a pistol having a hand frame member with a generally flat butt portion, the assembly comprising:

a magazine insertion guide having a flat upper surface for engaging the butt portion of the handle frame member, a plurality of guide securing members extending upwardly from the upper surface of the magazine insertion guide and spaced for close-fitting relation to the handle frame member;

a pair of opposing hand grips that are removably attachable to the sides of the hand frame member, the interior surfaces of the grips being contoured to receive the guide securing members in a close-fitting interlocking relation;

whereby the magazine insertion guide is secured in position on the butt portion of the frame member when the grips are attached to the frame member.

2. The assembly of claim 1 in which the guide securing members include a leg portion which terminates in an outwardly disposed flange.

3. The assembly of claim 1 in which the securing member terminates in an opening and the grip includes an interior projecting member that is received in the opening of the adjacent securing member.

4. The assembly of claim 1 in which the securing members are integral with the guide.

5. The assembly of claim 1 in which the guide has one pair of securing members.

6. The assembly of claim 2 in which the securing members comprise rectilinear elements.

7. The assembly of claim 2 in which the portion of the securing member extending from the upper surface of the guide is 3.75 mm wide, 19.25 mm long and 2.75 mm thick and the lower surface of the flange extends 7.5 mm from the junction with the leg portion.

8. The assembly of claim 1 in which the grips are configured to replace the original equipment grips of a commercially produced pistol.

9. The assembly of claim 8 in which the pistol is a semi-automatic.

10. The assembly of claim 1 in which the guide is metal, plastic, or resinous fibre.

11. The assembly of claim 1 in which the guide and the grips are metal, plastic, or resinous fibre.

12. The assembly of claim 1 in which the guide is formed from a single piece of material.

13. A method of securing a magazine insertion guide to the butt portion of a pistol handle frame member, having a magazine receiver opening formed in the butt portion, the method comprising:

a. providing an insertion guide having a mating surface that is contoured to mate with the surface of the butt portion of the pistol that surrounds the receiver opening, the insertion guide also having a plurality of guide securing members extending upwardly from the upper surface of the magazine insertion guide and spaced for close-fitting relation to the handle frame member;

b. providing a pair of opposing hand grips that are removably attachable to the sides of the handle frame member, the interior surfaces of the grips being contoured to receive the guide securing members in a close-fitting interlocking relation;

c. positioning the mating surface of the insertion guide on the butt portion of the pistol and placing the opposing hand grips in engagement with the guide securing members; and d. securing the opposing hand grips to the handle frame member.

* * * * *